US006877445B2

(12) United States Patent
Könning et al.

(10) Patent No.: US 6,877,445 B2
(45) Date of Patent: Apr. 12, 2005

(54) CHAMBER HAVING DISCHARGE BASE

(75) Inventors: Ludwig Könning, Ahlen (DE); Thomas Rüther, Drehnsteinfurt (DE); Ralf Osburg, Beckum (DE); Ludger Brentrup, Oelde (DE); Holger Schmidthals, Beckum (DE); Martin Torner, Ennigerloh (DE)

(73) Assignee: Polysius AG, Beckum (DE)

( * ) Notice: Subject to any disclaimer, the term of this patent is extended or adjusted under 35 U.S.C. 154(b) by 0 days.

(21) Appl. No.: 10/335,654

(22) Filed: Dec. 31, 2002

(65) Prior Publication Data

US 2003/0131768 A1 Jul. 17, 2003

(30) Foreign Application Priority Data

Jan. 14, 2002 (DE) ..... 102 01 057

(51) Int. Cl.[7] ..... F23G 5/00; F23J 1/00

(52) U.S. Cl. ..... 110/259; 110/165 R; 110/285; 110/255

(58) Field of Search ..... 110/165 A, 165 R, 110/298, 259, 285, 286, 290, 291, 267, 255, 257; 209/3; 432/14; 126/167, 168, 152 B

(56) References Cited

U.S. PATENT DOCUMENTS 1,973,149 A * 9/1934 Tulip ..... 126/163 R
2,033,576 A * 3/1936 Hofft ..... 110/285
3,057,309 A * 10/1962 Turner et al. ..... 110/186
3,771,470 A * 11/1973 Hampton ..... 110/257
4,320,710 A * 3/1982 Steiner et al. ..... 110/281
4,563,959 A 1/1986 Fujiwara
4,676,176 A * 6/1987 Bonomelli ..... 110/281
4,884,516 A * 12/1989 Linsen ..... 110/281
4,913,067 A * 4/1990 Gaskin et al. ..... 110/281
4,987,837 A * 1/1991 Reschly et al. ..... 110/165 R
5,078,065 A * 1/1992 Tsunemi et al. ..... 110/259
5,476,377 A * 12/1995 Kupper et al. ..... 432/78
5,915,308 A * 6/1999 May et al. ..... 110/165 R
6,230,633 B1 * 5/2001 Magaldi et al. ..... 110/189
6,266,883 B1 * 7/2001 Heinemann et al. ..... 29/896.6

* cited by examiner

*Primary Examiner*—Kenneth Rinehart
(74) *Attorney, Agent, or Firm*—Muramatsu & Associates

(57) ABSTRACT

A chamber having a discharge base discharges an oversize fraction of a material and a fine fraction of the material separately from the chamber. The discharge base for the chamber for the heat treatment of the material is capable of separating the fine fraction of the material from the oversize fraction of the material. The discharge base has a plurality of conveyor elements which are movable to and fro for the discharge of the oversize fraction of the material. The discharge base is also provided with separator openings for separating out the fine fraction of the material. The conveyor elements are of bar-shape construction and are disposed in parallel to one another on the discharge base to be moveable in the direction of their longitudinal extent, and the separator openings are formed by longitudinal gaps between the conveyor elements.

13 Claims, 4 Drawing Sheets

CHAMBER HAVING DISCHARGE BASE

FILED OF THE INVENTION

The invention relates to a discharge base for a combustion chamber with a plurality of conveyor elements which are movable to and fro for the discharge of material as well as a chamber for the heat treatment of a material with such a discharge base.

BACKGROUND OF THE INVENTION

In chambers for the thermal preparation of alternative fuels, discharge bases are currently used for emptying the chamber which use a plurality of movable slide plates which are provided between rigid intermediate plates. In this case, the upper movable slide plates of the discharge base serve for conveying the residual substances out of the chamber to the discharge base and the lowest movable slide serves for transport of the residual material through the discharge channel to the method stage subsequent to the heat treatment.

However, such a discharge base with slides disposed one above the other and rigid intermediate plates disposed between them have the disadvantage that the material to be conveyed is compacted before it reaches the discharge channel. This severely impairs the transportability of the material through the discharge channel. Moreover, the subsequent method stages are frequently unsuitable for severely compacted residues.

SUMMARY OF THE INVENTION

It is, therefore, an object of the present invention to provide a discharge base for a combustion chamber with improved operations.

This object is achieved according to the discharge base of the present invention which is provided with a plurality of conveyor elements which are movable to and fro for the discharge of an oversize fraction of a material to be treated, and in addition, it has openings for separating out a fine fraction of the material.

In this way, a fine-grained, non-caking and free-flowing fraction of the material can be drawn off separately so that not only the fine fraction but also the remaining oversize fraction of the material can be further processed more flexibly.

The combustion chamber for the heat treatment of a material has a first discharge opening for an oversize fraction of the material to be treated as well as a discharge base with conveyor elements which are movable to and fro for the discharge of an oversize fraction via the first discharge opening. The discharge base also has openings for separating out a fine fraction of the treated material, the fine fraction being discharged via a second discharge opening.

Further embodiments of the invention are the subject matter of the subordinate claims.

In a preferred embodiment, the conveyor elements are of bar-shape construction and are movable to and fro in the direction of their longitudinal extent. Compacting of the material to be discharged can be largely avoided by a parallel arrangement of these conveyor bars which advantageously have entraining elements for discharge of the material.

Further advantages and embodiments are explained in greater detail below with reference to the description of an embodiment and the drawings.

DETAILED DESCRIPTION OF THE INVENTION

Figure 1:
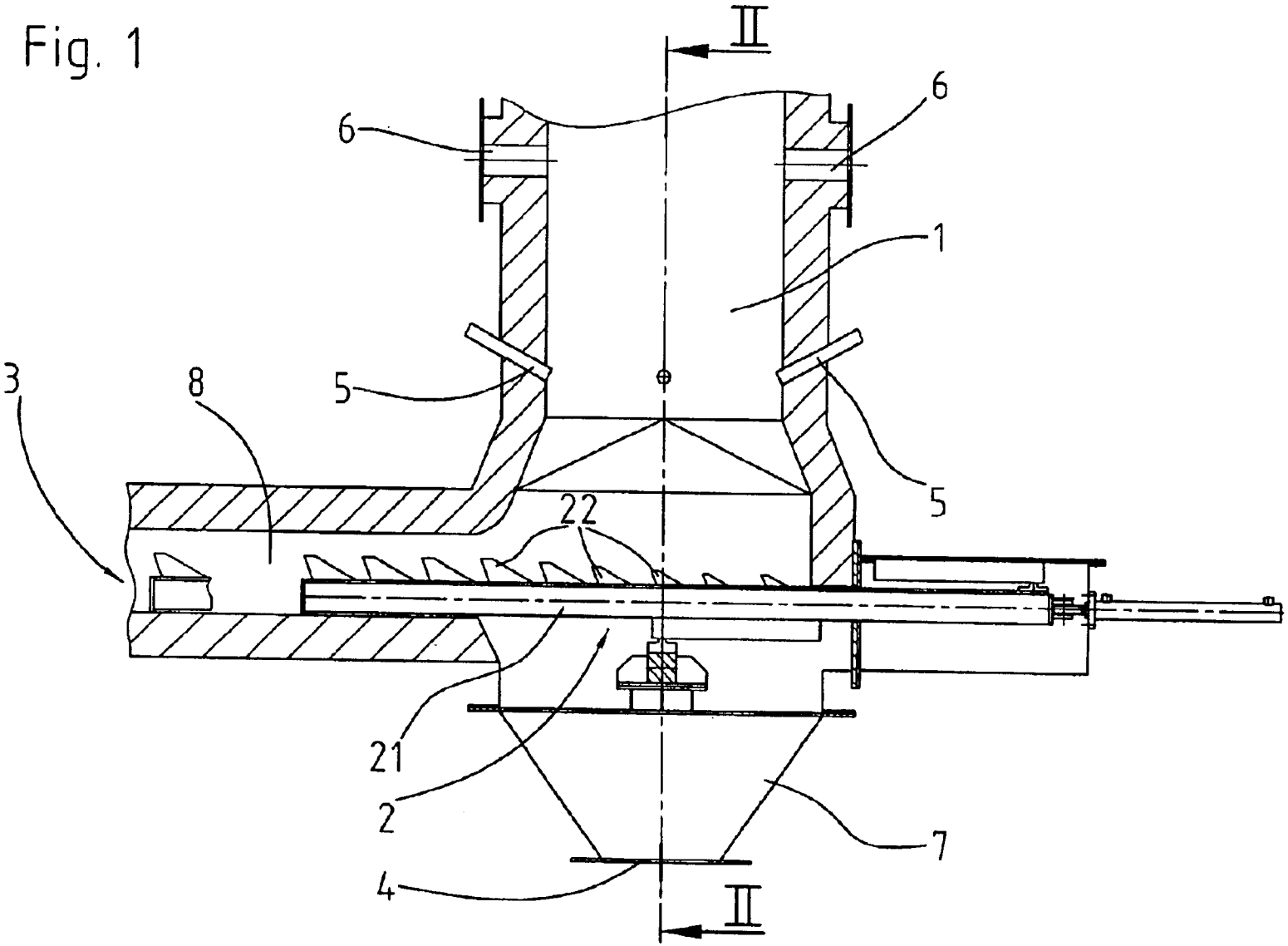
FIG. 1 shows a sectional view of a chamber for the heat treatment of a material.

FIG. 1 shows a sectional partial view of a chamber for the heat treatment of a material, particularly for the thermal preparation of alternative fuels. Basically, it comprises a combustion chamber 1 for the treatment of the material, a discharge base 2 for the discharge of the treated material, a first discharge opening 3 for an oversize traction of the treated material as well as a second discharge opening 4 for a fine fraction of the material.

The material to be treated, for example scrap tires, is thermally prepared in the combustion chamber 1 under a reducing atmosphere, for which reagent can be blown via jets 5 onto the material to be treated. The gas which forms during this process can be drawn off via a third discharge opening 6 and re-utilized in a suitable manner.

The heat treatment of the material breaks it down into finer and larger-sized constituents. During the heat treatment of scrap tires, fine-grained coke and a wire mesh are produced. The oversize fraction (wire mesh) and the fine fraction (coke) of the treated material are advantageously used in different ways in subsequent method stages.

For this purpose, the discharge base 2 is not constructed in the usual way so that it delivers all of the treated material to a discharge opening, but rather it has openings (separator openings) 20 in order to be able to separate out a fine fraction of the material and to draw it off separately from the oversize fraction of the material.

The construction and the mode of operation of the discharge base 2 are explained in greater detail below.

Figure 2:
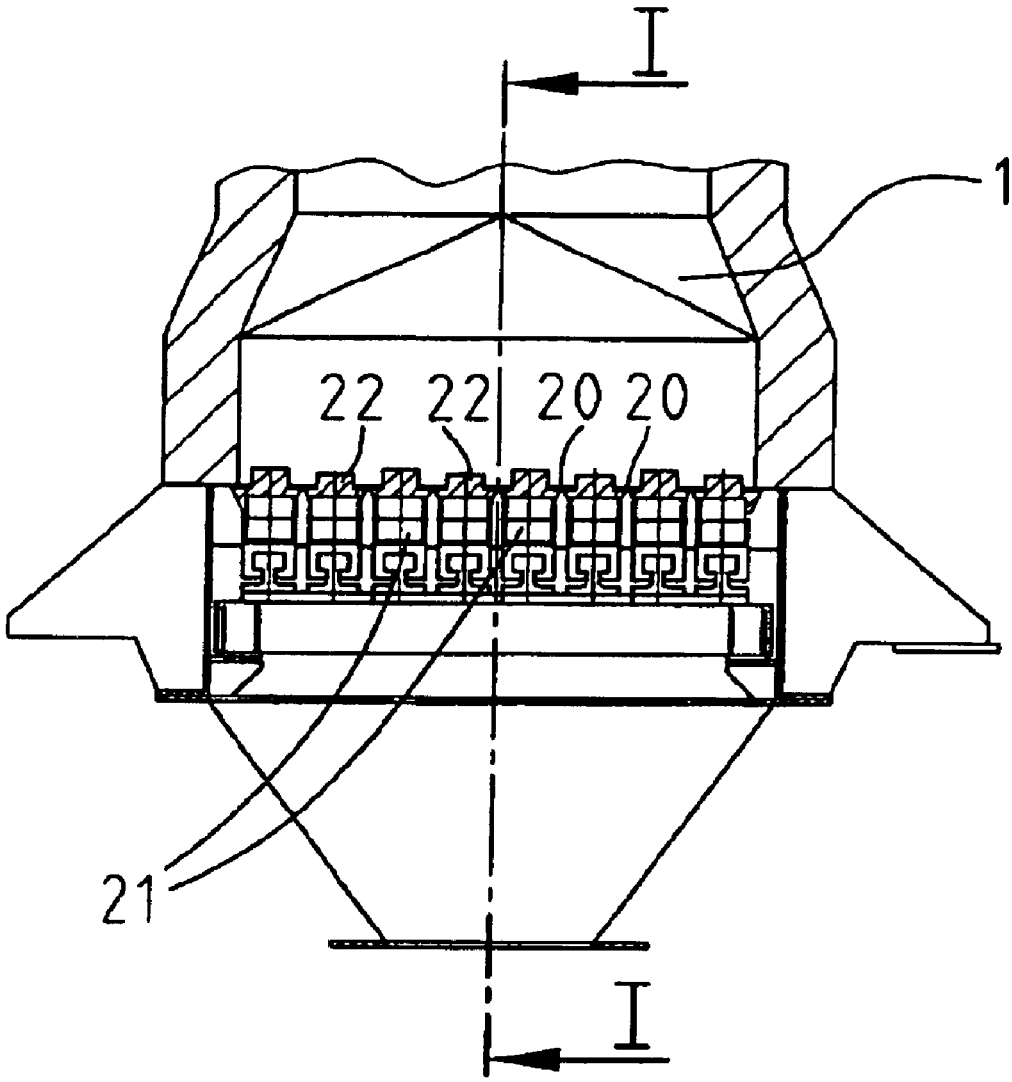
FIG. 2 shows a sectional view along the line II—II in FIG. 1.
Figure 3:
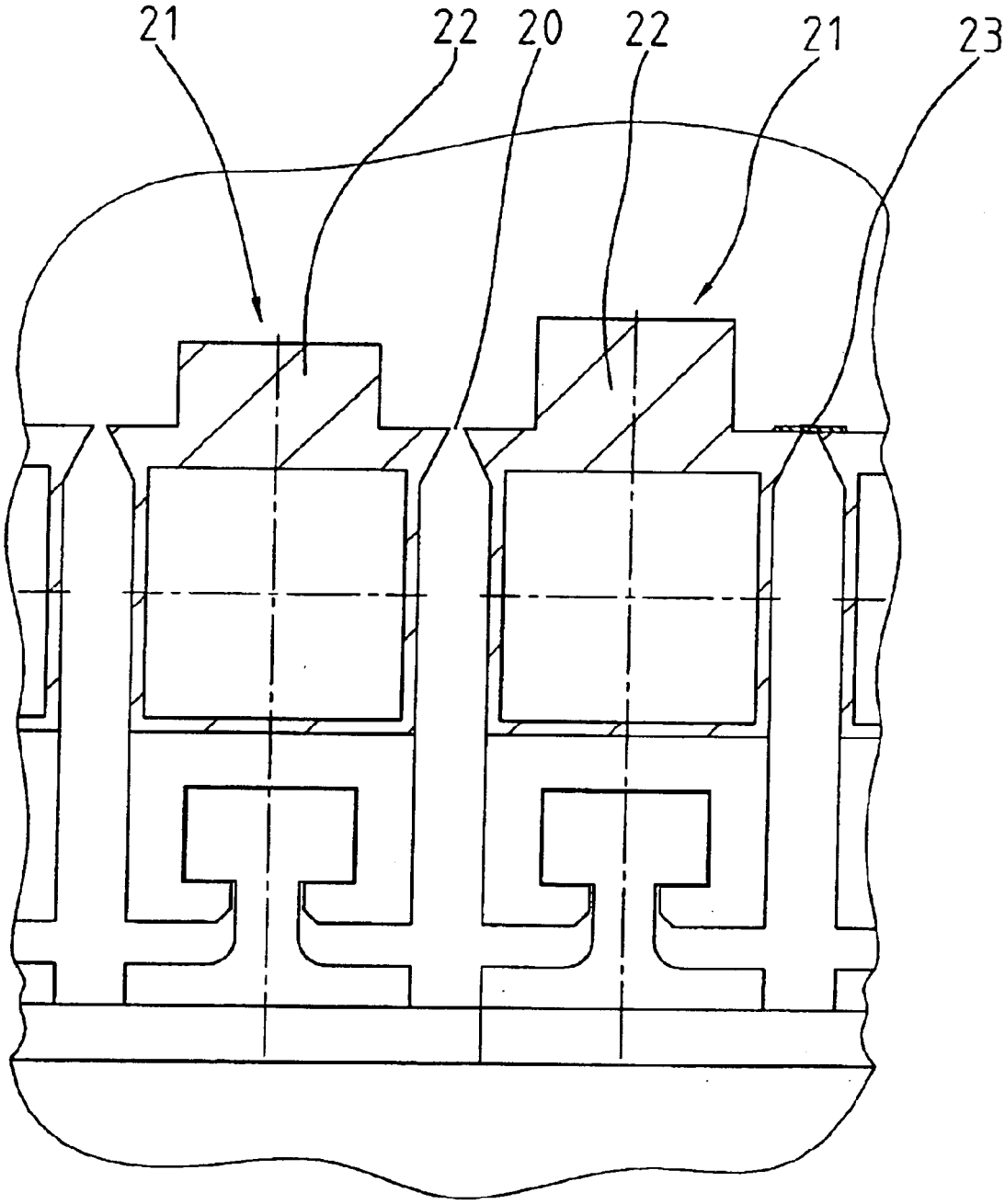
FIG. 3 shows a sectional detail view of FIG. 2 in the region of the discharge base.
Figure 4:
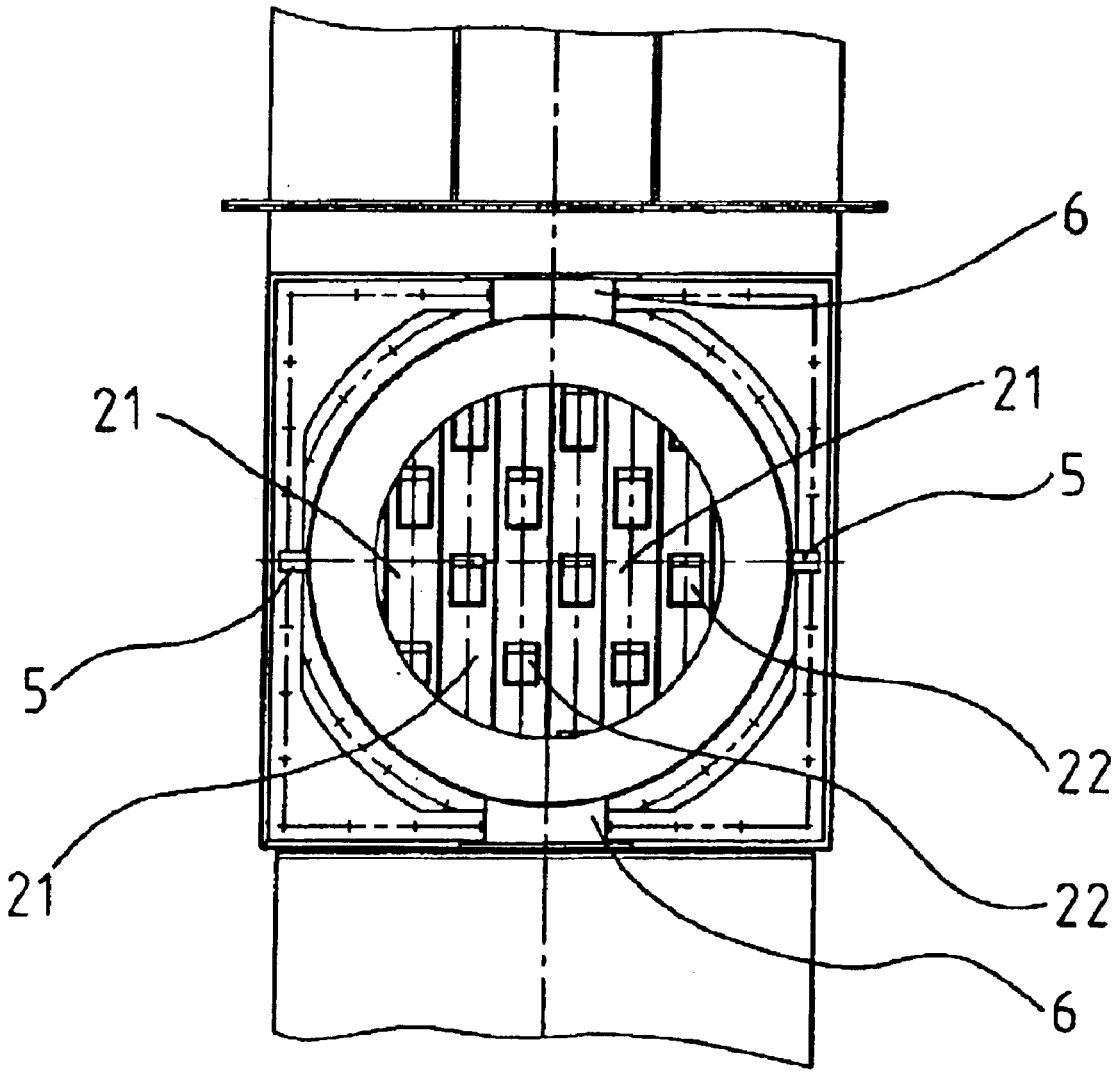
FIG. 4 shows a plan view of the chamber of FIG. 1.

The discharge base 2 has a plurality of conveyor elements 21 as shown in FIGS. 2–4 which are of bar-like construction and are movable to and fro in the direction of their longitudinal extent. As shown in FIGS. 2 and 3, these conveyor elements 21 are disposed parallel to one another in a plane so that they form a support surface for the treated material.

The separator openings 20 for separating out the fine fraction of the treated material are formed by gaps between adjacent conveyor elements 21. The width of the gap-shaped openings 20 is preferably adjustable in order to influence the fineness of the material which is separated out.

Suitable means, for example a hopper 7, are provided below the discharge base 2 in order to be able to draw off the fine fraction of the treated material which has been separated out and optionally to deliver it to a further method stage.

The gap-like openings 20 preferably extend over the entire length of the conveyor elements 21. As can be seen in particular from the detailed view according to FIG. 3, the gaps 20 widen downwards in a wedge shape so that blockages between the conveyor elements 21 can be avoided.

For the transport of the oversize fraction of the treated material, entraining elements 22, which are preferably of V-shaped construction and disposed with their substantially vertical side in the principal conveying direction, are provided on the side of the conveyor elements facing the material, as can be seen in particular from FIG. 1. However, within the scope of the invention, other entraining elements are also possible, and it is merely necessary to ensure that a sufficient conveying effect is achieved and the material is not transported back with the return stroke of the conveyor elements.

The individual conveyor elements are guided in suitable bearings, particularly linear bearings, and can be provided so as to be driven in groups or also individually. Thus in particular, it is conceivable that individual conveyor elements are actuated at different times and/or at different speeds not only with the forward stroke but also with the return stroke.

In particular, it is also conceivable that in one mode, adjacent conveyor elements are moved in opposite directions in order thereby to simplify the separating out of the fine fraction of the material.

Whilst the fine fraction is delivered downwards via the hopper 7 to the second discharge opening 4, the oversize fraction passes via a discharge channel 8 to the first discharge opening 3.

The entraining elements 22 can be designed differently both with regard to their height and with regard to their shape. As can be seen in particular from FIG. 1, the height of the entraining elements 22 increases in the direction of the discharge opening. However, it is also conceivable for example that the entraining elements which are located substantially in the discharge channel 8 are shaped differently from the entraining elements which are provided in the combustion chamber 1.

Depending upon the type of material to be treated and type of use, it may be advantageous if the openings 20 between adjacent conveyor elements 21 can be selectively covered by a cover 23 so that the treated material can be discharged without separating out a fine fraction (FIG. 3). In this case, it is conceivable within the scope of the invention for all or only some of the openings to be covered.

Since during the heat treatment of material relatively high temperatures often occur, the conveyor elements 21 are of hollow construction, as shown in particular in FIG. 3. The conveyor elements of hollow construction can then have a suitable coolant flowing through them for the purpose of cooling.

The apparatus described above is distinguished in particular by the fact that unnecessary compacting of the treated material is largely avoided, and moreover, the fine fraction can be separated out and drawn off in a simple manner. In this way a more targeted and more effective exploitation of the individual constituents of the treated material is possible.

What is claimed is:

1. A chamber for heat treatment of a material, comprising:

a first discharge opening for discharging an oversize fraction of the treated material from the chamber;

a discharge base with a plurality of conveyor elements which are movable to and fro for discharge of the oversize fraction of the treated material via the first discharge opening; and separator openings formed on the discharge base for separating out a fine fraction of the treated material and discharging the fine fraction of the material from the chamber through a second discharge opening separately from the oversize fraction of the material;

wherein the conveyor elements are of bar-shape construction and are disposed on the discharge base so as to be moveable in the direction of their longitudinal extent, and the conveyor elements are disposed parallel to one another in a plane, the separator openings are formed by longitudinal gaps between the conveyor elements.

2. A chamber as claimed in claim 1, wherein the separator openings are constructed between adjacent conveyor elements on the discharge base.

3. A chamber as claimed in claim 1, wherein the conveyor elements have entraining elements for discharging the oversize fraction of the treated material.

4. A chamber as claimed in claim 3, wherein entraining elements of different heights are provided.

5. A chamber as claimed in claim 3, wherein entraining elements of different shapes are provided.

6. A chamber as claimed in claim 1, wherein the conveyor elements are disposed parallel adjacent to one another.

7. A chamber as claimed in claim 1, wherein at least two groups of conveyor elements are provided which can be driven separately.

8. A chamber as claimed in claim 1, wherein each conveyor element is provided with its own drive.

9. A chamber as claimed in claim 1, wherein the conveyor elements can be driven at a variable speed and/or with a variable stroke length.

10. A chamber as claimed in claim 1, wherein size of the separator openings of the discharge base can be adjusted in order to influence fineness of the material which is separated out.

11. A chamber as claimed in claim 1, wherein the conveyor elements are of hollow construction and have a coolant flowing through them for the purpose of cooling.

12. A chamber as claimed in claim 1, wherein covers are also provided in order to cover at least some of the separator openings selectively.

13. A chamber as claimed in claim 1, wherein the width of the separator openings on the discharge base regulates the fineness of the material which is separated out.

* * * * *